US006479797B1

(12) United States Patent
Yanagimoto et al.

(10) Patent No.: US 6,479,797 B1
(45) Date of Patent: Nov. 12, 2002

(54) SNOW MELTING APPARATUS AND HEATING WIRE FOR MELTING SNOW

(75) Inventors: Kiyoshi Yanagimoto, Okayama (JP); Motohiro Nishii, Okayama (JP)

(73) Assignee: Tigers Polymer Corporation, Toyonaka (JP)

( * ) Notice: Subject to any disclaimer, the term of this patent is extended or adjusted under 35 U.S.C. 154(b) by 0 days.

(21) Appl. No.: 09/708,077

(22) Filed: Nov. 8, 2000

Related U.S. Application Data

(63) Continuation-in-part of application No. 09/587,618, filed on Jun. 5, 2000.

(51) Int. Cl.[7] ..... H05B 1/00

(52) U.S. Cl. ..... 219/213; 219/525; 219/536; 219/542

(58) Field of Search ..... 219/200, 201, 219/202, 203, 209, 213, 520, 522, 525, 532, 536, 537, 541, 542

(56) References Cited

U.S. PATENT DOCUMENTS 2,018,293 A * 10/1935 Williams et al. ..... 219/213
4,163,144 A * 7/1979 Reynier ..... 219/213
5,550,349 A * 8/1996 Bomba ..... 219/213
6,166,352 A * 12/2000 Turton ..... 219/213

FOREIGN PATENT DOCUMENTS

| | | |
|---|---|---|
| JP | 03-006758 | 1/1991 |
| JP | 09-078517 | 3/1997 |
| JP | 10-106729 | 4/1998 |

* cited by examiner

*Primary Examiner*—Tu Ba Hoang
(74) *Attorney, Agent, or Firm*—Oblon, Spivak, McClelland, Maier & Neustadt, P.C.

(57) ABSTRACT

A snow melting apparatus 1 according to the present invention comprises a plurality of heating wires 10, a pair of fixing members 20, 20 and rod-shaped auxiliary fixing members 30. The plurality of heating wires 10 are arranged substantially in parallel with each other at predetermined intervals in a director perpendicular to its axial direction. The fixing members fix and hold the plurality heating wires at end portions thereof. The rod-shaped auxiliary fixing member holds the plurality of heating wires at intermediate positions thereof. Accordingly, it is possible to provide a snow melting apparatus which holds a certain flexing capability, which causes no damage to the joining force between a base layer and a surface layer of a driveway, and which does not fail completely even if the apparatus partially breaks at a single position therealong.

4 Claims, 6 Drawing Sheets

SNOW MELTING APPARATUS AND HEATING WIRE FOR MELTING SNOW

This application is a continuation-in-part (CIP) of prior application No. 09/587,618 filed on Jun. 5, 2000.

BACKGROUND OF THE INVENTION

The present invention relates to a snow melting apparatus and heating wire for melting snow, and more particularly to a snow melting apparatus and heating wire and adapted to be laid in driveways, walkways, parking lot or the like in regions having lots of snow for preventing accumulation of snow and freezing at those specific places.

In regions having lots of snowfalls, snow accumulating on the surfaces of driveways and frozen road surfaces endangers traffic travelling thereon and due to the accumulation of snow and frozen road surfaces There are caused traffic jams along driveways, often resulting in a paralysis of physical distribution.

With a view to preventing the accumulation of snow on the road surfaces and freezing thereof, on top of mechanically removing accumulating snow, there have been proposed many devices for removing snow in various ways. Raised as one of them is a method for laying underneath road surfaces electric heating apparatus using nichrome wires as a medium.

Japanese Utility Model Registration No. 3006758 discloses as a conventional electric heating apparatus a known road heater in which a linear heating element is covered with a fabric structure. This heater requires a continuos material to be laid while fixing it at appropriate positions, and such laying work is found inefficient. In addition, with such a continuous material, the diameter thereof tends to inevitably become larger to prevent increase in electric resistance, and this reduces the flexing capability of the material, which is then liable to break. Moreover, if the continuous material breaks even at a single position therealong, it leads to a problem that the whole heating apparatus fails.

Furthermore, Japanese Patent Unexamined Publication No. Hei.10-106729 discloses as a surface heating element a mat-like heating element in which a meandering conductor is covered with a flexible epoxy resin. This surface heating element is laid between a basic layer of concrete and a top or surface layer of asphalt. However, since the surface heating element completely separates the basic layer and the surface layer, it provides a problem that the strength of the road surface becomes weakened. In addition, since no flexing capability is provided, the heating element is not appropriate to be laid along a curved driveway. In addition, Japanese Patent Unexamined Publication No. Hei. 9-78517 discloses a snow, melting unit in which a linear heating element is laid on a net. Since this snow melting unit comprises a mesh-like net, the problem inherent in the aforesaid heating element is solved that it lacks the joining force between the base layer and he surface layer. However, due to its flexing capability, this linear heating element still suffers from the conventional problem that the element is difficult to be laid along a curved driveway. Also, another conventional problem remains unsolved; that is, since the element comprises a linear heating element, if it breaks even at a single position, the whole element fails.

In a construction site, the heating wires and power supply cords are electrically connected. However, in the connection work, it is required that the covers of the wires and cords are removed, and insulation sealing is applied to the joining portions by winding an insulating tape therearound.

Additionally, the diameter of the heating, wire is different from that of the power supply cord. Accordingly, the connection work is complicated and troublesome. Further, there is a chance that heat by asphalt and load acting thereon will damage the insulation of the apparatus.

SUMMARY OF THE INVENTION

It is an object of the present invention is to provide a snow melting apparatus which has a satisfactory bending strength and does not impair the joining portion between a road base layer and a road surface layer. Another object of the invention is to provide a snow melting apparatus which is normally operable even if disconnection occurs at one location, and heating wires for melting snow which are excellent in bending resistance property. Yet another object of the invention is to provide a snow melting apparatus which allows the work in a construction site to smoothly be done, and is free from dielectric breakdown. Still another object of the invention is to provide a snow melting apparatus which has good bending resistance property.

To achieve the above objects, there is provided a first aspect of a snow melting apparatus comprising: at least two heating wires bent like U; fixing members for fixing and holding both end portions of the heating wires; and connecting cords for electrically connecting the ends of the heating wires within the fixing members.

In the first aspect of the snow melting apparatus thus constructed, at least two heating wires bent like U are fixed and held with fixing members. The heating wires are fixed at the end portions and keeps a fixed arrangement of them, and may be laid along a curve driveway and the like. Further, no damage is caused to the joining force between a base layer and a surface layer of a driveway, and there is no chance of decreasing a strength of the surface layer.

A second aspect of the snow melting apparatus of the invention comprises: a plurality of heating wires arranged in parallel at predetermined intervals; fixing members for fixing and holding the end portions of the heating wires; and auxiliary fixing members, shaped like bars, for holding intermediate positions of the plurality of heating wires at predetermined intervals.

In the thus constructed second aspect of the snow melting apparatus, a plurality of heating wires are arranged in parallel at predetermined intervals, the end portions of the heating wires are held and fixed with the fixing members, and intermediate positions of the plurality of heating wires are held with auxiliary fixing members, shaped like bars. With this construction, the heating wires keep an arrangement of them while not meandered. Further, there is no chance of impairing the joining portion between a road base layer and a road surface layer, and reducing a strength of the road surface layer. Further, the heating wires are fixed at points with the auxiliary fixing member. Good bending property is secured and it is easy to lay those wires along a curved driveway and the like.

Additionally, in the first and second aspects of the snow melting apparatuses, since a plurality of heating wires are used, if those heating wires are connected by use of connecting cords to form a parallel electric circuit, increase of electric resistance of the whole snow melting apparatus is suppressed. Therefore, there is no need of increasing the heating wires in diameter. Further, if one heating wire is disconnected, there is no chance that the whole apparatus is put to an inoperable state.

Further, if the end portions of the heating wires are electrically connected to connecting cords and power supply cords within the fixing members by means of press-contact terminals, the troublesome work of wiring the snow melting apparatus in the site is eliminated. If the fixing members are made of a rubber material or a resin material, insulation and load-resistance performances of the snow melting apparatus are improved.

When the fixing members are formed by using a rubber material or a resin material, if the end portions of the heating wires connected to connecting cords and a power supply cord, and then those end portions, together with those connecting portions, are covered with a rubber material or a resin material, the fixing members are formed in an integral form. If the fixing members are so constructed, the electric connection portions are buried within the rubber or resin, so that good insulation performance is ensured.

According to another aspect of the invention, there is provided heating wires in which a heating member, which includes a core wire formed with heat-resistance fibers and a heating resistance wire wound around the outer circumference of the core wire in a spiral fashion, is covered with a protecting layer, and the resultant is buried in the asphalt layer of the road. In the heating wires, the end portions of the heating wires are electrically connected to connecting cords and power supply cords within the fixing members by means of press-contact terminals.

In the heating wires, the heating resistance wire are wound around the outer circumference of the core wire in a spiral fashion. Therefore, their bending resistance is excellent. As a result, there is no chance that their resistance value abnormally changes and the wire is disconnected. Further, the end portions of the heating wires are electrically connected to connecting cords and power supply cords within the fixing members by means of press-contact terminals. Therefore, there is no need of troublesome wire connecting work in the site. Accordingly, the heating wires are suitable for those of the snow melting apparatus.

In the heating wires, it is preferable that the core wire is formed with an aromatic polyamide fiber and the heating resistance wire is formed with stainless steel fibers. The combination of those materials presents good bending resistance property.

DESCRIPTION OF THE PREFERRED EMBODIMENTS

Referring to the accompanying drawings, a preferred embodiment of a snow melting apparatus according to the present invention will be described below.

Figure 1A:
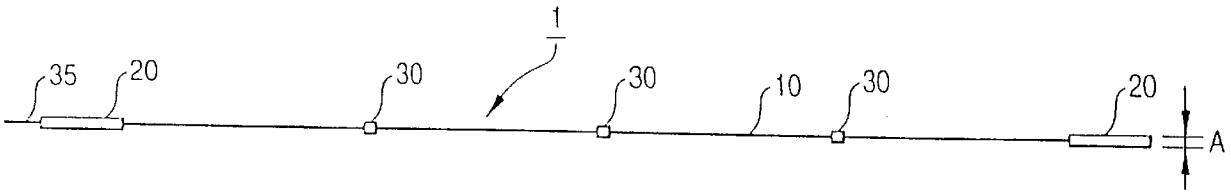
FIG. 1A is a front view showing a first embodiment of a snow melting apparatus and FIG. 1B is a plan view thereof.
Figure 1B:
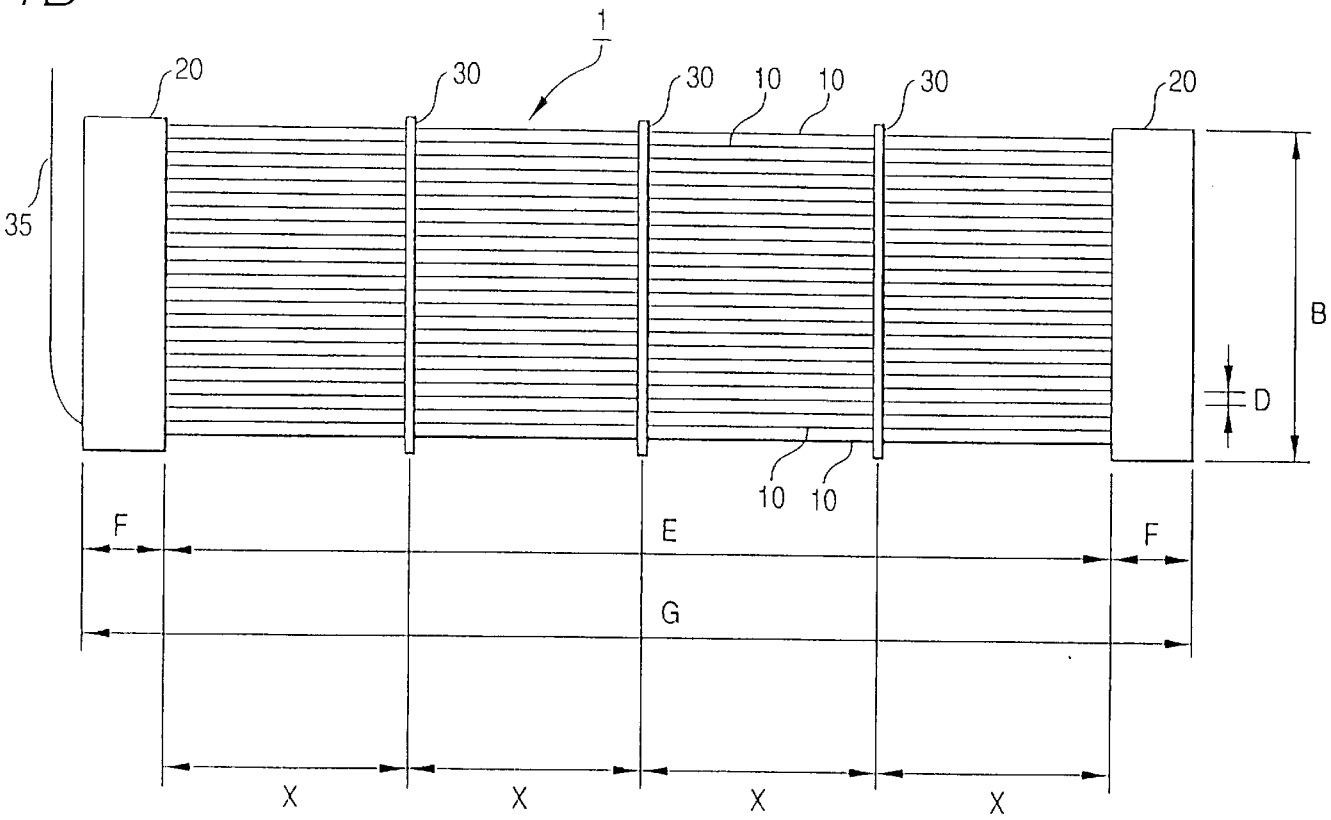

In a first embodiment of the invention, as shown in FIG. 1, a snow melting apparatus 1 according to the invention comprises a plurality or heating wires 10 which are arranged in parallel with one another with predetermined intervals Y in a direction substantially perpendicular to the axial direction thereof, fixing members 20 for fixing and holding the respective heating wires 10 at end portions thereof, rod-like auxiliary fixing members 30 for holding the respective heating wires 10 at intermediate positions thereof at predetermined intervals X in the axial direction of the heating wire 10, and a power supply cord 35.

Figure 2:
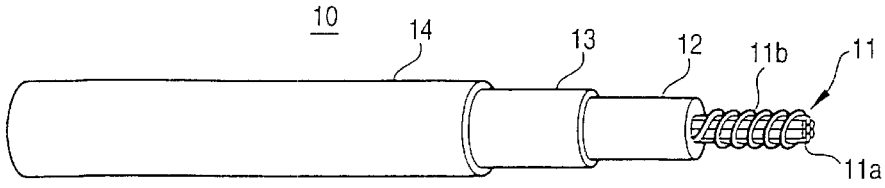
FIG. 2 is a perspective view snowing heating wires constituting the snow melting apparatus.

As shown in FIG. 2, each of the heating wires 10 comprises, as viewed from the center to the periphery, a heating element 11, an insulating element 12, a sheath 13 and a braid 14. Furthermore, the heating element 11 comprises in turn a core wire 11*a* and a heating resistance wire 11*b*. The core wire 11*a* comprises heat-resistant, strong threads, and it is preferable to use therefor an aromatic polyamide fiber (such as one marketed by DuPont Inc under a trade name of KEBLER) or glass fiber. The heating resistance wire 11*b* is wound around the outer circumference of the core 11*a* in a spiral fashion, and such materials, nichrome wires, copper wires and copper-nickel wires may be used thereof.

The heating resistance wire 11*b* is wound on the outer circumference of the core wire 11*a* in a spiral fashion, and it may be micrometal fiber, such as a stainless steel fiber one marketed by Nihon Seisen Inc. under a trade name of NASURON. In the first embodiment, eight number of the stainless steel fibers (each consisting of a bundle of 100 number of stainless steel fibers each having a diameter of 12 $\mu$m) are wound around the outer circumference of the core wire 11*a* formed with an aromatic polyamide fiber in a spiral fashion. The heating resistance wire 11*b* may be nichrome wires, copper wires and copper-nickel wires or the like.

A heat-resistant rubber is preferably used for the insulating element 12 and for example, ethylene-propylene rubber or silicone rubber may be used. The sheath 13 is also preferably made of a material having an insulating property, and for example, polychloroprene is preferable. The braid 14 is preferably made of a mesh comprising a stainless wire to bear the external pressure and tension which act thereon.

Figure 3:
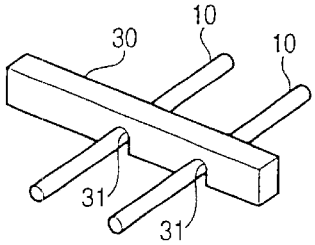
FIG. 3 is a perspective view showing auxiliary fixing members of the snow melting apparatus.

The fixing member 20 comprises a rubber material or a resin material and is adapted to fix and hold the end portions of the respective heating wires 10. The auxiliary fixing member 30 comprises a rubber material or a resin material and as shown in FIG. 3 holds the heating wires 10 at notched portions 31 in a state that the wires 10 are fitted in the notched portions 31. These auxiliary fixing members 30 are used so as to hold the plurality of heating wires 10 at the predetermined intervals, and the number of auxiliary fixing members to be used is optional (refer to FIG. 1).

Figure 4:
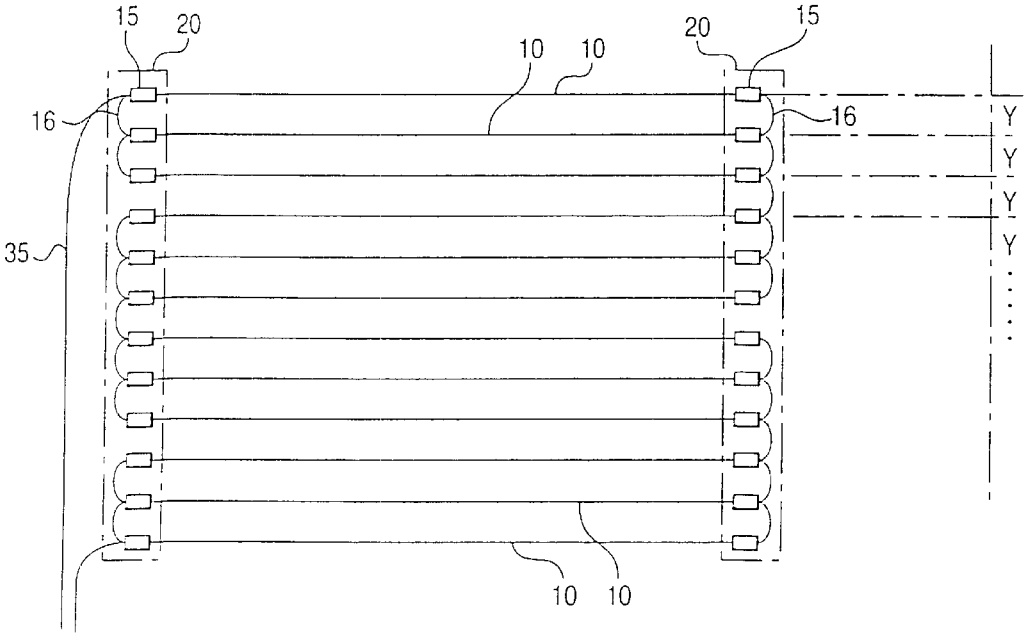
FIG. 4 is an explanatory view showing electric connections of the heating, wires in the snow melting apparatus.

In addition, as shown in FIG. 4, sets of three heating wires 10 are electrically connected in parallel within the fixing members 20. In other words, terminals 15 are attached to the ends of each of the heating wires 10, and connecting cords 16 are laid for electric connection therebetween. Those wires are also connected to power supply cord 35 at the terminals 15. If press-contact terminals are used for the terminals 15, connection work will be easy. If the snow melting apparatus is wired in a factory before the apparatus is installed, the wiring work will be eliminated in a construction site, and reliable check of the wiring is secured.

Since the fixing members 20 are made of a rubber material or a resin material, it not only secures an insulation but also endures a load from the surface (asphalt) when the snow melting apparatus containing the fixing members is laid in the road or the like.

The fixing members 20 are formed , by press molding, in a manner that both end portions of the heating wires 10 are inserted into a mold (not shown) in a state that those are electrically connected to the connecting cords 16 and the power supply cord 35, and the mold is filled with non-vulcanizing plain rubber. Accordingly, the connection portions of both end portions of heating wires 10 are buried in a rubber layer, so that those are reliably fixed and held.

In addition to the press-molding method, another method may be used for forming the fixing members 20. For example, the fixing members may be formed in an integral form in a manner that the connection portions of both end portions of the heating wires 10 are covered by injection molding of a rubber material or a resin material.

A table 1 shown below is a specification table prepared by the inventors and describes two types or specifications actually used in experiments carried out by the inventors, in which Embodiment 1 used an apparatus whose overall length is 2 m and Embodiment 2 an apparatus whose overall length is 4 m, and the watt density was 300w/m$^2$ for both.

TABLE 1

| | Embodiment 1 | Embodiment 2 |
|---|---|---|
| Dimention | | |
| Thickness A | 9 mm (rubber portion) | 9 mm (rubber portion) Width B 850 mm 850 mm Length C 2340 mm 4540 mm |
| Heating wire pitch | 70.0 mm | 70.0 mm |
| Heating wire diameter | 7 mm | 7 mm |
| Heating wire dimensions E × B | 2100 mm × 850 mm | 4300 mm × 850 mm |
| Fixing member width F | 120 mm | 120 mm |
| Working voltage | 120 V | 120 V |
| Power consumption | 552 W | 1103 W |
| Watt density | 300 W/m$^2$ | 300 W/m$^2$ |

Figure 5:
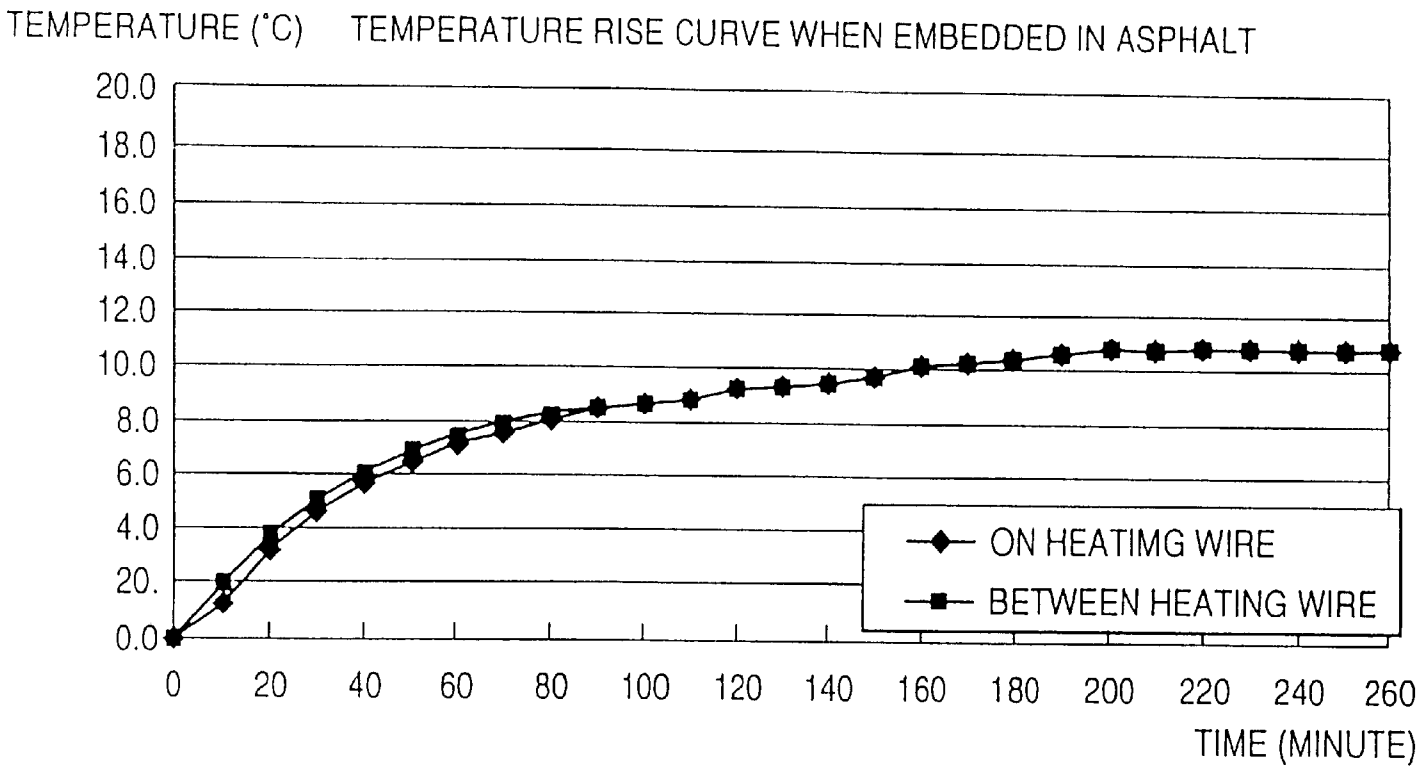
FIG. 5 is a graph showing temperature rise properties of the snow melting apparatus.
Figure 6A:
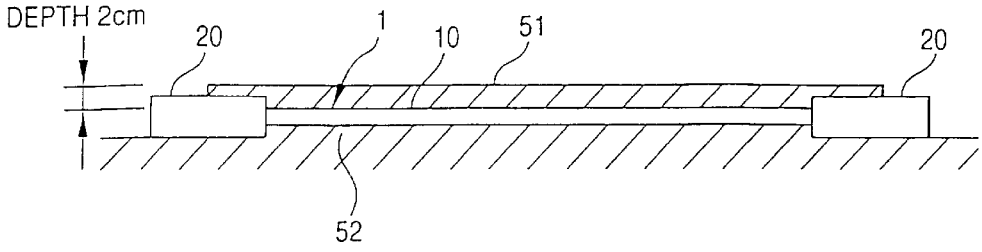
FIG. 6 is a sectional view of a state in which the temperature rise properties were measured.
FIG. 6B is a plan view thereof.
Figure 6B:
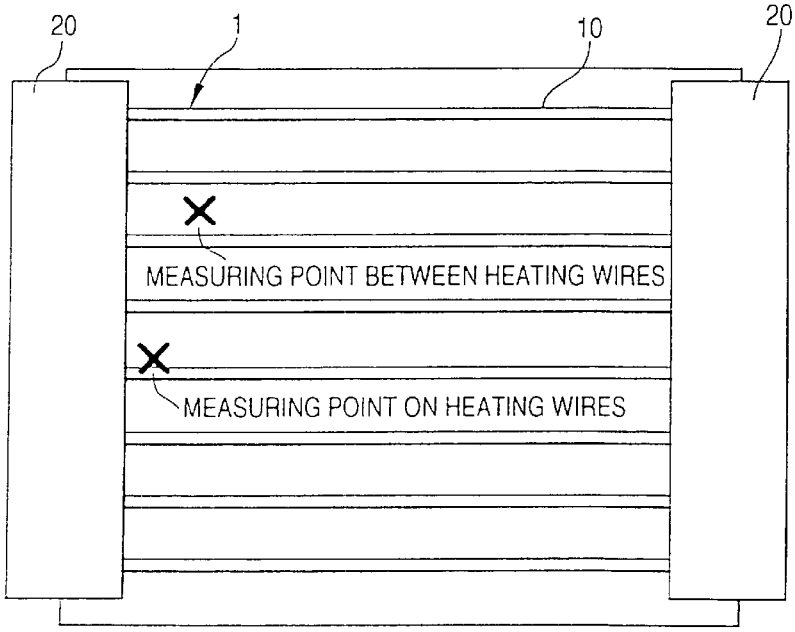

Next the snow melting apparatus 1 constructed as described above were laid/embedded in an asphalt-paved driveway which was prepared as a model and shown in FIG. 5 are the results of measuring temperature increases on the heating wires 10 and between them for both the embodiments. As shown in FIG. 6, these measurements were carried out with he heating wires 10 being embedded 2 cm deep in an asphalt surface layer 15. In addition, reference numeral 52 denotes a base layer of concrete.

In the snow melting apparatus 1 so prepared, since asphalt is filled between the plurality of heating wires 10 and the plurality of auxiliary fixing members 30, no deterioration is caused to the joining force between the base layer and the surface layer, and therefore the strength of the surface layer can be held sufficiently. In addition, since the interval of the heating wires 10 is maintained at the predetermined interval with the auxiliary fixing members 30, the heating wires can easily be laid out. In addition, the construction of the wires also helps maintain the general flexing capability of the wires, whereby the heating wires can also easily be laid out even in a curved driveway.

Figure 7:
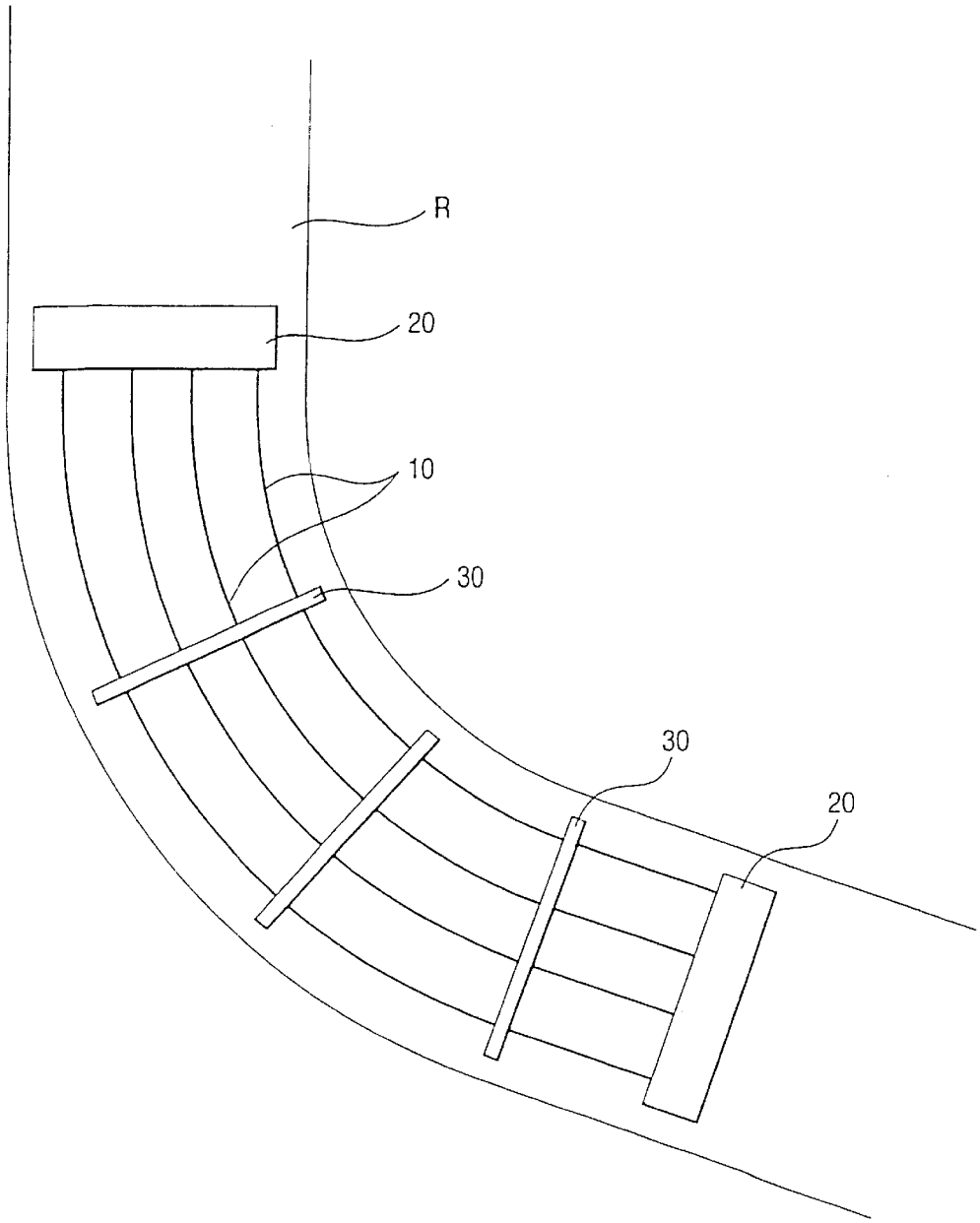
FIG. 7 is a plane view of the snow melting apparatus which is laid out along a curved driveway.

For example, as shown in FIG. 7, the snow melting apparatus 1 is laid out along the curved driveway. At this time, the heating wires 10 are deformed or curved while maintaining the predetermined intervals between adjacent heating wires with the auxiliary fixing members 30.

Furthermore, since the plurality of heating wires 10 are connected to each other such that electric parallel circuits are constructed, the increase in electric resistance is generally restrained, and therefore, the increase in diameter the heating resistance wire 11 is also restrained. Moreover, even if one of the heating wires breaks, the remaining heating wires are not functionally affected by such breakage, whereby there is caused no risk of failure to the entirety of the apparatus.

Figure 8:
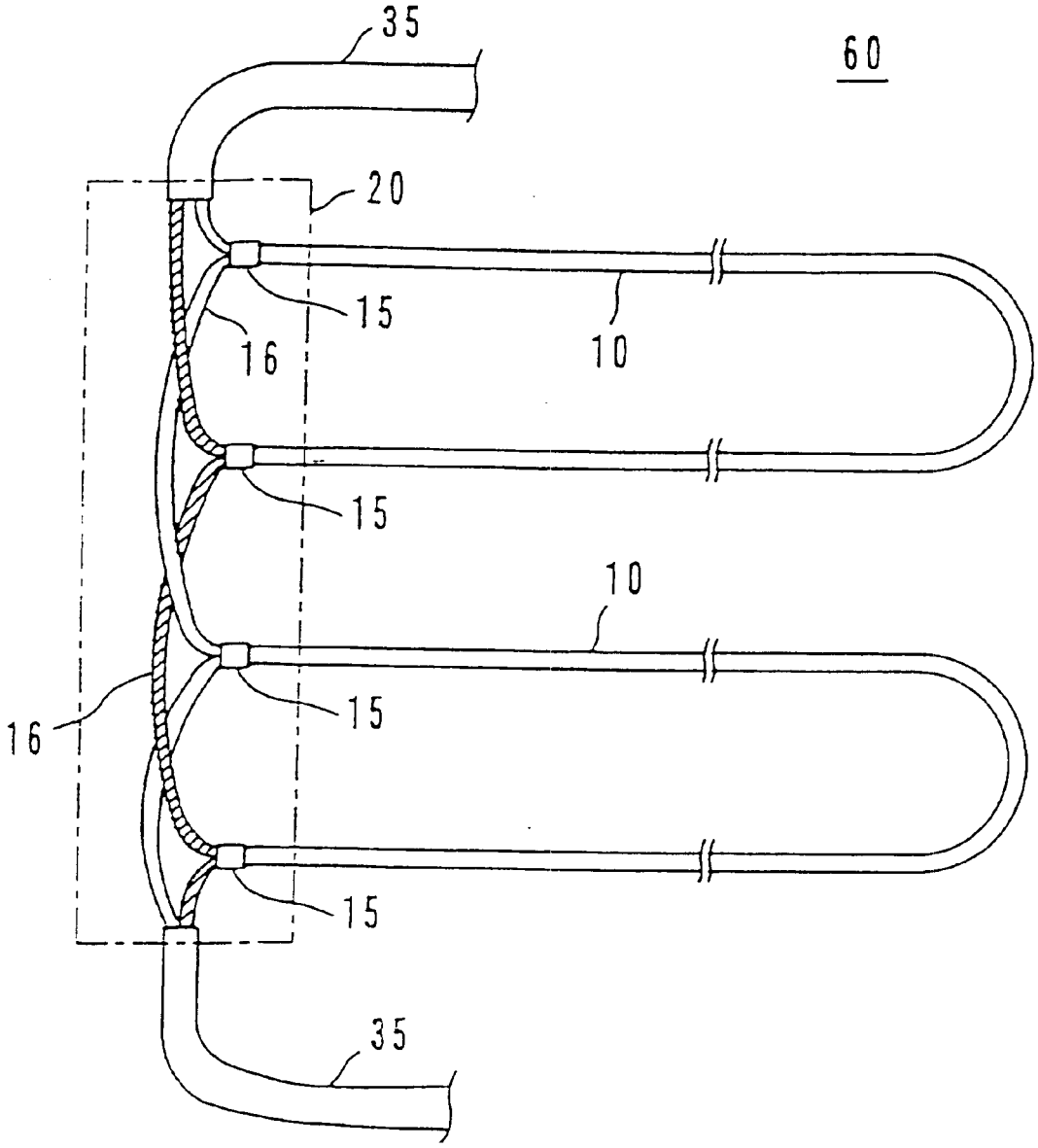
FIG. 8 is a plane view showing a second embodiment of a snow melting apparatus.

Next, according to a second embodiment of the invention as shown in FIG. 8, a snow melting apparatus 60, which is a second embodiment of the present invention, comprises pairs of heating wires 10, shared like U, and fixing members 20 for fixing and holding the end portions of the heating wires 10. A power supply cord 35 and connecting cords 16 are connected to the ends of the heating wires 10 by means of press-contact terminals 15. The wiring is such that those pairs of heating wires 10 are connected in parallel. In a case where a plurality of units each consisting of the snow melting apparatus 60 shown in FIG. 8 are installed, if one of the heating wires 10 is disconnected, the disconnection does not affect the remaining heating wires 10. If necessary, the pair of heating wires 10 may be connected in series. The auxiliary fixing member 30 in the first embodiment may be used, if required.

The heating wires 10 and the fixing members 20 used in the second embodiment resemble those as described in the first embodiment. Hence, no description of them is given here. The operation and effects of the second embodiment are also substantially the same as those in the first embodiment.

As the following, it will be explained that a bending resistance property of the joining portion of the heating wires and the fixing members.

In the first and second embodiments, the ends of the heating wires 10 are connected and to and fixed at the rubber or resin fixing members 20. Then, the following test was conducted by the inventors. In the test, the connection portions of the heating wires 10 to the fixing members 20 were horizontally swung over a range of an angle of about 100° 1000 times, 10,000 times and 50,000 times. The states of those connection portions were examined after the bending. The results of the test are shown in Table 2. The fixing members 20 used in the test are made of a rubber material, and the heating wires 10 are formed with the combination of the stainless steel fibers and an aromatic polyamide fiber.

TABLE 2

| | | |
|---|---|---|
| 1000 times | resistance value | Not changed |
| | insulation resistance | normal (2000MΩ or higher) |
| | external appearance | normal |
| 1000 times | resistance value | Not changed |
| | insulation resistance | normal (2000MΩ or higher) |
| | external appearance | normal |
| 5000 times | resistance value | Not changed |
| | insulation resistance | normal (2000MΩ or higher) |
| | external appearance | normal |

As seen from FIG. 2, after the connection portions are bent 50,000 times, no resistance change is found, and no abnormality is found in the insulation resistance and the external appearance.

It should be understood that the snow melting apparatus and the heating wires for melting snow are not limited to the above mentioned embodiments, but may variously be modified, altered and changed within the true spirits of the invention.

In addition, the present invention is not limited to the snow melting apparatus described heretofore with respect to the mode for carrying out the invention, but it may be modified variously without departing from the sprit and scope of the invention.

In particular, the sizes of the apparatus or the constituent components may be established in accordance with the road conditions and the heating performance required, on top of the above embodiments 1, 2. In addition, the construction of the heating wires and electric wiring may be modified as required.

While there has been described in connection with the preferred embodiment of the invention, it will be obvious to those skilled in the art that various changes and modifications may be made therein without departing from the invention, and it is aimed, therefore, to cover in the appended claim all such changes and modifications as fail within the true spirit and scope of the invention.

What is claimed is:

1. A snow melting apparatus comprising:

at least two heating wires which are respectively formed into a U-shape, each of said heating wires having two end portions;

a fixing member which fixes and holds both end portions of each of said heating wires, said fixing member being made of a rubber or resin material; and connecting cords which electrically connect the end portions of said heating wires within said fixing member.

2. The snow melting apparatus according to claim 1, wherein said heating wires are buried in a ground region.

3. The snow melting apparatus according to claim 1, wherein said heating wires are electrically connected in parallel as a plurality of parallel circuits.

4. A snow melting apparatus according to claim 1, wherein said fixing member is integrally molded rubber or resin material with first portions for connecting the end portions of the heating wires to the connecting cords and second portions for connecting the end portions of the heating wires to the power supply cords, and wherein the first and second portions are embedded in the fixing member.

* * * * *